US006899071B2

(12) United States Patent
Eiji et al.

(10) Patent No.: US 6,899,071 B2
(45) Date of Patent: May 31, 2005

(54) LASH ADJUSTER FOR VALVE ACTUATOR

(75) Inventors: Maeno Eiji, Shizuoka (JP); Yamamoto Ken, Shizuoka (JP)

(73) Assignee: NTN Corporation, Osaka (JP)

( * ) Notice: Subject to any disclaimer, the term of this patent is extended or adjusted under 35 U.S.C. 154(b) by 34 days.

(21) Appl. No.: 10/458,181

(22) Filed: Jun. 11, 2003

(65) Prior Publication Data

US 2004/0211380 A1 Oct. 28, 2004

(30) Foreign Application Priority Data

Jun. 12, 2002 (JP) ..... 2002-171611

(51) Int. Cl.[7] ..... F01L 1/14

(52) U.S. Cl. ..... 123/90.52; 123/90.54; 123/90.43

(58) Field of Search ..... 123/90.43, 90.54, 123/90.45, 90.52

(56) References Cited

U.S. PATENT DOCUMENTS 4,548,168 A 10/1985 Gill 4,981,117 A * 1/1991 McRobert et al. ..... 123/90.43

FOREIGN PATENT DOCUMENTS

| | | |
|---|---|---|
| JP | 3-501758 | 4/1991 |
| JP | 2000-130114 | 5/2000 |
| WO | 89/05898 | 6/1989 |

* cited by examiner

*Primary Examiner*—Thomas Denion
*Assistant Examiner*—Zelalem Eshete
(74) *Attorney, Agent, or Firm*—Wenderoth, Lind & Ponack, L.L.P.

(57) ABSTRACT

A lash adjuster is provided which can maintain stable valve lift. An adjuster screw is mounted into a threaded hole formed in the bottom of the end plate of a lifter body. An elastic member is mounted in the threaded hole to bias the adjuster screw axially downwardly. The female threads of the threaded hole and the male threads of the adjuster screw are serration-shaped. A plurality of axial grooves are formed in the inner periphery of the threaded hole to circumferentially divide the female threads into many separate portions, and satin-finished rough surfaces are formed on the pressure flanks of the male threads by shot-peening to enable quick expulsion of oil film disposed between the opposed pressure flanks, thereby stabilizing the valve lift.

2 Claims, 10 Drawing Sheets

Shot peening on the adjuster screw + axial groove on the nut

Axial groove + helical groove on the nut

Before endurance test

After endurance test

Lash adjuster with no grooves

Lash adjuster with axial grooves

LASH ADJUSTER FOR VALVE ACTUATOR

BACKGROUND OF THE INVENTION

This invention relates to a lash adjuster for automatically adjusting the valve clearance in a valve actuator of an internal combustion engine.

A valve actuator for opening and closing intake or exhaust valves (hereinafter simply "valves") by rotating its cam includes a lash adjuster mounted between the cam and the valve to automatically adjust the valve clearance therebetween.

U.S. Pat. No. 4,548,168 discloses such a lash adjuster which includes a lifter body having an end plate kept in contact with a cam and formed with a blind threaded hole in its bottom surface. An adjuster screw is in threaded engagement with the threaded hole and is biased axially by an elastic member mounted between the top end of the screw and the closed end of the threaded hole. The female threads of the threaded hole and the male threads of the adjuster screw are serration-shaped so that the pressure flank to which a push-in load applied to the adjuster screw is applied has a larger flank angle than the clearance flanks.

This lash adjuster is mounted between a cam and the stem of a valve. A valve spring biases the valve toward the cam to press the end of the valve stem against the bottom end of the adjuster screw. As the cam rotates with the valve stem pressed against the adjuster screw, the valve stem is moved up and down between its open position and closed position of the valve.

If a valve clearance forms between the top end of the valve stem and the adjuster screw due e.g. to thermal expansion of the cylinder head, under the force of the elastic member, the adjuster screw will move axially downward while turning in one direction with the clearance flanks of the screw sliding along the clearance flanks of the nut until the valve clearance disappears.

Conversely, if the pressure from the valve stem is applied to the adjuster screw, the adjuster screw is pushed up or retracts until the axial play between the pressure flanks of the female threads and the male threads disappears. Once the play disappears, the adjuster screw cannot be pushed up any further because the frictional force between the pressure flanks is large.

But if, for example, the valve seat is worn, when the engine is started, large force will be momentarily applied to the adjuster screw from the stem when the stem rises and abuts the screw, thus pushing up the screw against the large frictional force between the pressure flanks, until the valve face is completely seated on the valve seat. Thus, it is possible to completely shut the valve when the base circle of the cam contacts the end plate of the lifter body, even if the valve seat is worn. This prevents pressure leakage. In this case, the adjuster screw is pushed up until the axial gaps between the pressure flanks disappear after the force from the valve stem has disappeared.

On the other hand, in a situation where no valve clearance adjustment is necessary while the engine is running, the adjuster screw scarcely turns and moves axially within the gap or play between the female threads of the threaded hole and the male threads of the adjuster screw.

That is, the pressure flanks of the male threads of the adjuster screw repeatedly collide against and move away from the pressure flanks of the female threads.

In the valve assembly, lubricating oil such as engine oil is present. Such lubricating oil inevitably flows into between the pressure flanks and forms an oil film. When the adjuster screw undergoes an axial load, the pressure flanks tend to expel such oil film when they move toward each other. The oil film produces a pressure against the pressure from the pressure flanks. The oil film has a load-bearing limit. If the pressure applied from the pressure flanks to the oil film exceeds this maximum load limit, the oil film will break up and will be discharged. The pressure flanks of the male and female threads thus directly contact each other. Since the friction between the pressure flanks is large, it prevents the adjuster screw from turning.

On the other hand, if the pressure applied to the oil film from the pressure flanks balances with the load-bearing limit of the oil film, the oil film will remain therebetween. That is, the pressure flanks are practically separated from each other by the oil film. Thus, the adjuster screw tends to retract toward the closed end of the threaded hole while turning due to reduced friction between the pressure flanks. This reduces the valve lift amount.

Generally it is known that the smaller the total area of the pressure flanks, the smaller the load-bearing limit of the oil film. Also, by dividing the pressure flanks to the greater number of sections for a given area of the pressure flanks, it is also possible to reduce the load-bearing limit of the oil film.

JP patent publication 03-501758 proposes a lash adjuster including an adjuster screw having a plurality of circumferential grooves formed in the pressure flanks to reduce the load-bearing limit of oil film present between the pressure flanks, so that the oil film can be expelled smoothly and quickly, thereby stabilizing the lift of the valve.

JP patent publication 2000-130114 discloses a lash adjuster in which a plurality of axial grooves are formed in the inner periphery of a threaded hole formed in the lifter body at circumferential intervals to circumferentially divide the pressure flank of the female thread into many small sections, thereby expelling the oil film smoothly and quickly.

The lash adjuster disclosed in either of the abovementioned Japanese publications has one problem that when the pressure flanks of the female and male threads are abraded and get worn, the contact surfaces tend to become smooth. This reduces friction between the pressure flanks to such an extent as not to be able to check the rotation of the adjuster screw.

One way to avoid this problem is to roughen the pressure flanks of the female and male threads. But ruggedness formed by such rough surfaces are not sufficient to efficiently discharge oil film. Especially in a low-temperature condition in which the viscosity of lubricating oil becomes high, it takes time to expel oil and thus the adjuster screw can slip and turn, so that the valve lift decreases.

The load-bearing limit of the oil film varies with the distance between the opposed pressure flanks, their area, shape and speed at which they move toward each other, viscosity of lubricating oil, etc. FIGS. 11A and 11B are graphs showing the relationship between the distance between the opposed pressure flanks and the ambient temperature and the load-bearing limit of the oil film.

The graph of FIG. 11A shows the results for a lash adjuster in which the female threads of the threaded hole formed in the lifter body and the male threads of the adjuster screw have pressure flanks and clearance flanks provided alternating with the pressure flanks so that the pressure flanks have a greater flank angle than the clearance flanks. This lash adjuster has no axial grooves as used in the lash adjuster disclosed in JP patent publication 2000-130114. The graph of FIG. 11B shows the results for the same lash adjuster as used in FIG. 11A except that it has the axial grooves as used in JP publication 2000-130114.

The graph of FIG. 11A shows that the load-bearing limit of the oil film increases sharply with increase in the viscosity of the oil film, which in turn increases with reduction in the temperature. Even while the distance between the pressure flanks of the female and male threads is relatively large, the pressure-bearing force of the oil film may balance with the axial load transmitted from the cam to the valve through the lash adjuster at low temperature.

FIG. 11B shows that the shorter the distance between the pressure flanks, the greater the load-bearing force of the oil film. Thus, if the pressure flanks become smooth due to wear, the distance therebetween before they contact decreases. Thus, even if the pressure flanks are circumferentially divided into small sections, the load-bearing force of the oil film can grow rather large.

An object of this invention is to provide a lash adjuster in which oil film disposed between the opposed pressure flanks can be expelled smoothly and quickly from when the distance between the opposed pressure flanks is large to the instant they contact, and even after the pressure flanks have been worn due to long use, friction sufficient to keep the adjuster screw from turning is maintained between the opposed pressure flanks, so that stable valve stroke is maintained.

SUMMARY OF THE INVENTION

According to this invention, there is provided a lash adjuster comprising a lifter body including an end plate having a top surface and a bottom surface formed with an axial blind threaded hole having female threads, the lifter body axially slidably mounted between a cam and a stem of a valve with the top surface in contact with the cam, an adjuster screw having male threads on its outer periphery which are in threaded engagement with the female threads of the threaded hole, and an elastic member mounted in the threaded hole so as to bias the adjuster screw axially, the female threads of the threaded hole and the male threads of the adjuster screw being serration-shaped and having pressure flanks which receive pressure applied to the adjuster screw in such a direction as to push the adjuster screw into the threaded hole, and clearance flanks arranged between the adjacent pressure flanks, the pressure flanks having a greater flank angle than the clearance flanks, one of the inner periphery of the threaded hole and the outer periphery of the adjuster screw being formed with a plurality of axial grooves that divide the female threads or the male threads into a plurality of separate sections in a circumferential direction, and the pressure flanks of the female threads or the male threads divided by the axial grooves being formed with rugged surfaces.

From another aspect of the invention, there is provided a lash adjuster comprising a lifter body including an end plate having a top surface and a bottom surface formed with an axial blind threaded hole having female threads, the lifter body axially slidably mounted between a cam and a stem of a valve with the top surface in contact with the cam, an adjuster screw having male threads on its outer periphery which are in threaded engagement with the female threads of the threaded hole, and an elastic member mounted in the threaded hole so as to bias the adjuster screw axially, the female threads of the threaded hole and the male threads of the adjuster screw being serration-shaped and having pressure flanks which receive pressure applied to the adjuster screw in such a direction as to push the adjuster screw into the threaded hole, and clearance flanks arranged between the adjacent pressure flanks, the pressure flanks having a greater flank angle than the clearance flanks, one of the inner periphery of the threaded hole and the outer periphery of the adjuster screw being formed with a plurality of axial grooves that divide the female threads or the male threads into a plurality of separate sections in a circumferential direction, and the pressure flanks of the female threads or the male threads that are not circumferentially divided by the axial grooves are formed with rugged surfaces.

In either invention, the rugged surfaces may be formed by helical grooves formed along the lead of the threads or satin-finished surface formed by shot-peening.

In either invention, oil film can be quickly expelled from between the opposed pressure flanks from the time when a distance is present between the pressure flanks to the time when they contact each other.

The rugged surfaces formed on the pressure flanks divided circumferentially into small sections keep sufficient roughness and thus a frictional coefficient sufficient to prevent the adjuster screw from being pushed into the threaded hole while turning, even if the pressure flanks get worn with prolonged use. This stabilizes the valve lift.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1:
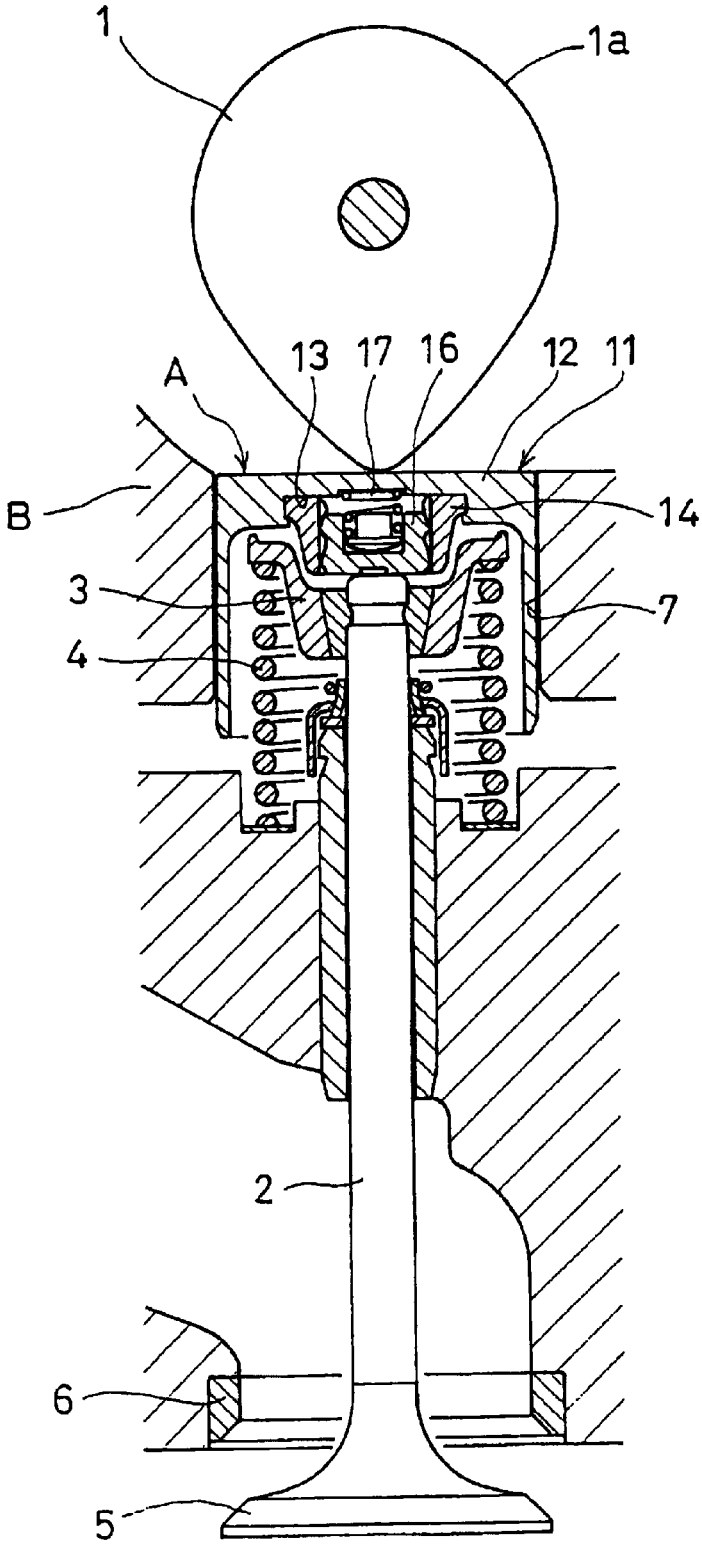
FIG. 1 is a vertical sectional front view of a valve actuator in which is mounted the lash adjuster according to this invention.

Now referring to the drawings, the lash adjuster embodying the present invention will be described. First referring to FIG. 1, the lash adjuster A embodying this invention is mounted between a cam 1 of a direct type valve actuator and a valve stem 2.

The valve stem 2 carries a spring retainer 3 at its top end. A valve spring 4 biases the spring retainer 3 and thus the valve stem 2 upwardly to keep a valve head 5 pressed against a valve seat 6.

Figure 2:
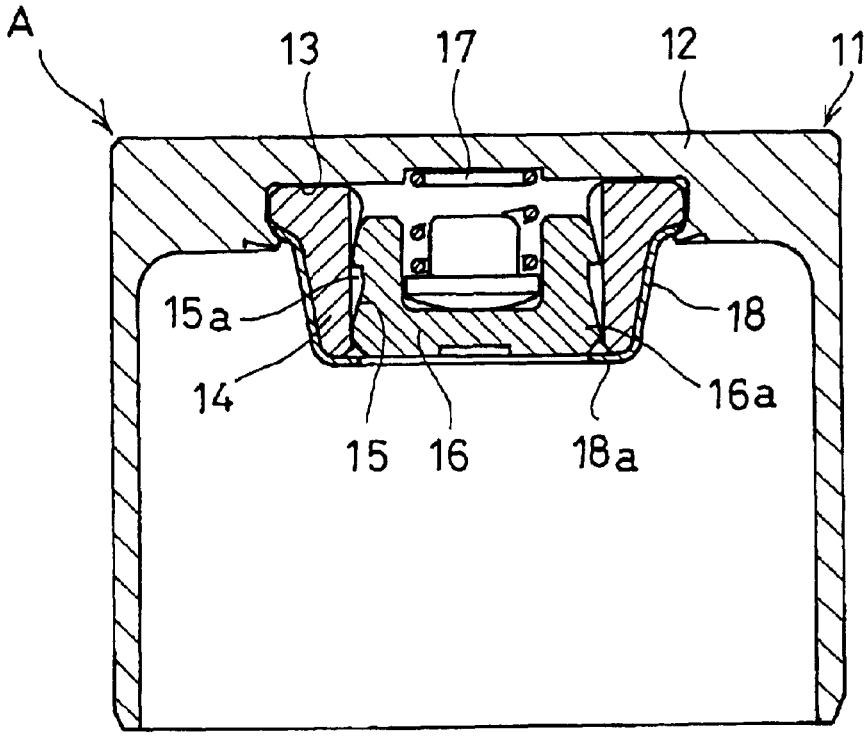
FIG. 2 is a vertical sectional front view of the lash adjuster shown in FIG. 1.

As shown in FIG. 2, the lash adjuster A includes a lifter body 11. As seen in FIG. 1, the lifter body 11 is slidably mounted in a guide hole 7 formed in a cylinder head B. The lifter body 11 has an end plate 12 that is kept in contact with the cam 1. A recess 13 is formed in the bottom surface of the end plate 12. The lash adjuster A further includes a nut 14 having its upper portion received in the recess 13 of the lifter body 11. In this embodiment, the nut 14 is made integral with the lifter body 11 by caulking the edge of the recess 13.

But instead, the nut 14 may be fixed to the lifter body 11 with any other means such as by brazing.

The nut 14 has a threaded hole 15 having its top end closed by the end plate 12. An adjuster screw 16 is in threaded engagement with the threaded hole 15 of the nut 14 and is biased axially downwardly by an elastic member 17 mounted in the threaded hole 15 between the end plate 12 and the adjuster screw 16. A cap 18 (FIG. 2) formed by pressing is fitted on the nut 14. Together with the nut 14, the cap 18 is also fixed to the lifter body 11 by caulking the edge of the opening of the recess 13. At its bottom, the cap 18 has a flange 18*a* that abuts the bottom of the nut 14, and also prevents the fall of the adjuster screw 16 from the threaded hole 15.

Figure 3:
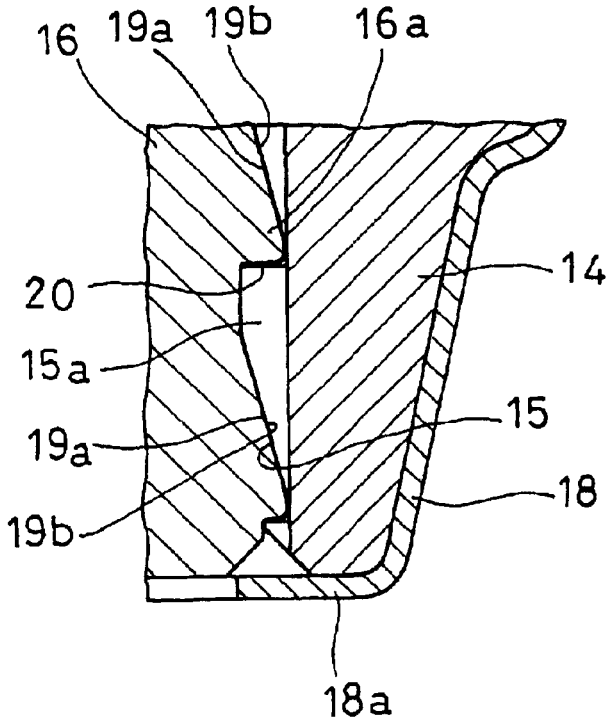
FIG. 3 is a partial enlarged view of FIG. 2.

Referring to FIG. 3, the female threads 15*a* of the threaded hole 15 and the male threads 16*a* of the adjuster screw 16 both have pressure flanks 19*a*, 19*b*, which receive pressure applied to the adjuster screw 16 in such a direction that the screw 16 is pushed into the nut 14, and clearance flanks 20*a*, 20*b* provided alternately with the pressure flanks 19*a*, 19*b* and having a smaller flank angle than the pressure flanks 19*a*, 19*b*. Thus, as a whole, the female threads 15*a* and the male threads 16*a* are serration-shaped. Further, the threads 15*a* and 16*a* have such a lead angle that under the pressure applied to the adjuster screw 16 from the elastic member 17, the adjuster screw 16 can move axially downward while turning.

With the lash adjuster A mounted in a valve actuator, if a valve clearance exists between the top end of the valve stem 2 and the adjuster screw 16 e.g. due to thermal expansion of the cylinder head B, under the pressure of the elastic member 17, the adjuster screw 16 moves axially downward along the clearance flanks 20*a*, 20*b* while turning in one direction until the valve clearance disappears.

Conversely, if the pressure from the valve stem 2 is applied to the adjuster screw 16 while the engine is at a stop, the adjuster screw 16 is pushed up until any axial gaps between the pressure flanks 19 of the female threads 15*a* and the male threads 16*a* disappear. Once the gaps disappear, the adjuster screw 16 cannot be pushed up any further because the frictional force between the pressure flanks 19*a*, 19*b* is large.

But if, for example, the valve seat 6 is worn, so that the distance between the top end of the valve stem 2 and the cam 1 decreases, the adjuster screw 16 will be pushed by a variable load applied from the valve stem 2 so as to retract while turning. This prevents the valve head 5 from being closed incompletely when the base circle 1*a* of the cam 1 gets into contact with the end plate 12 of the lifter body 11. Thus, it is possible to completely shut the valve when the base circle 1*a* of the cam 1 contacts the end plate 12 of the lifter body 11, even if the valve seat is worn.

On the other hand, in ordinary operating situations where no valve clearance adjustment is necessary while the engine is running, the adjuster screw 16 scarcely turns, and repeatedly displaces axially only within the gaps between the female threads 15*a* of the threaded hole 15 and the male threads 16*a* of the adjustor screw 16.

That is, the pressure flanks 19*b* on the male threads 16*a* of the adjuster screw 16 repeatedly collide against and move away from the pressure flanks 19*b* on the female threads 15*a*. In the valve assembly, lubricating oil is present. Such lubricating oil inevitably flows into between the pressure flanks 19*a*, 19*b*. It is necessary to expel such lubricating oil as quickly as possible when the pressure flanks 19*a*, 19*b* move toward each other. If lubricating oil has not been expelled from between the pressure flanks 19 when the pressure flanks contact each other, the lubricating oil will reduce the frictional force between the pressure flanks 19*a*, 19*b*, thereby allowing the adjuster screw 16 to move axially upwardly relative to the lifter body 11 while rotating in one direction. This reduces the lift of the valve.

Figure 5A:
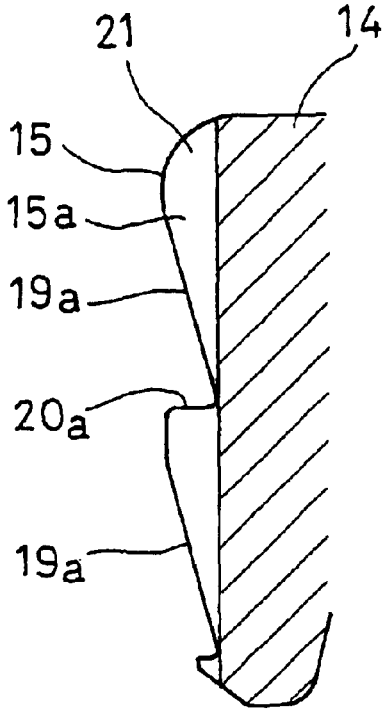
FIGS. 5A–5C are sectional views showing female threads of different nut members.
Figure 5B:
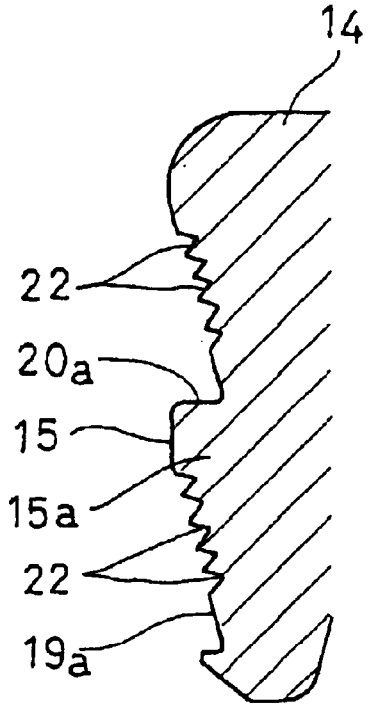
Figure 5C:
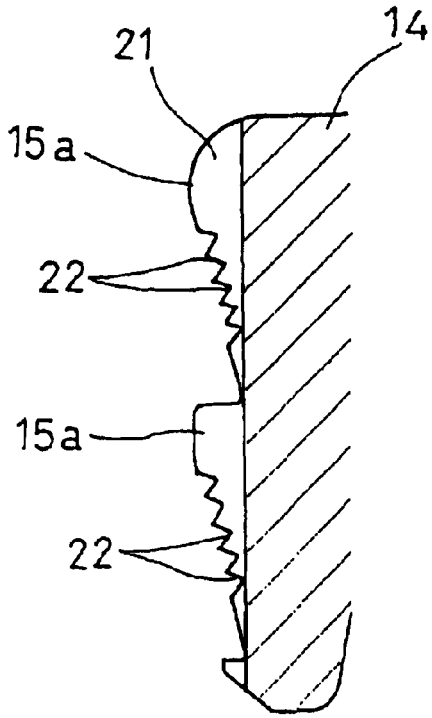

In order to expel lubricating oil from between the pressure flanks 19*a*, 19*b* as quickly as possible when the pressure flanks 19*a*, 19*b* move toward each other, the female threads 15*a* of the nut member 14 are configured as shown in FIGS. 5A–5C and/or the male threads 16*a* of the adjuster screw 16 are configured as shown in FIGS. 6A–6D.

In the example of FIG. 5A, a plurality of axial grooves 21 are formed in the inner periphery of the nut 14 so as to circumferentially divide the female threads 15 into a plurality of separate portions.

In FIG. 5B, a plurality of helical grooves 22 are formed in the pressure flanks 19*a* of the female threads 15*a* of the nut 14 to form roughened surfaces.

The nut 14 shown in FIG. 5C has both the axial grooves 21 shown in FIG. 5A and the helical grooves 22 shown in FIG. 5B.

The helical grooves 22 shown in FIGS. 5B and 5C are formed by tapping and are preferably 0.1–0.5 mm deep.

Figure 6A:
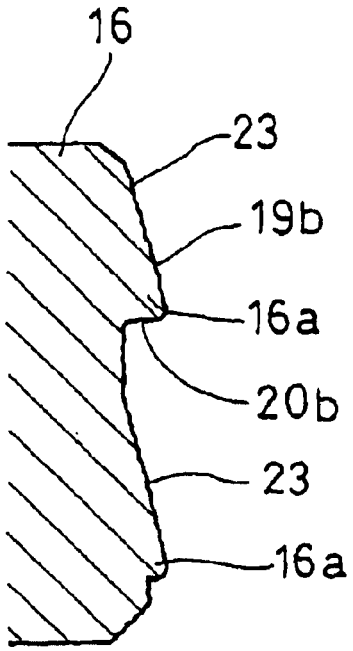
FIGS. 6A–6D are sectional views showing male threads of different adjuster screws.

In FIG. 6A, the pressure flanks 19*b* of the male threads 16*a* of the adjuster screw 16 are subjected to shot-peening to form satin-finished surfaces 23 thereon.

Figure 7:
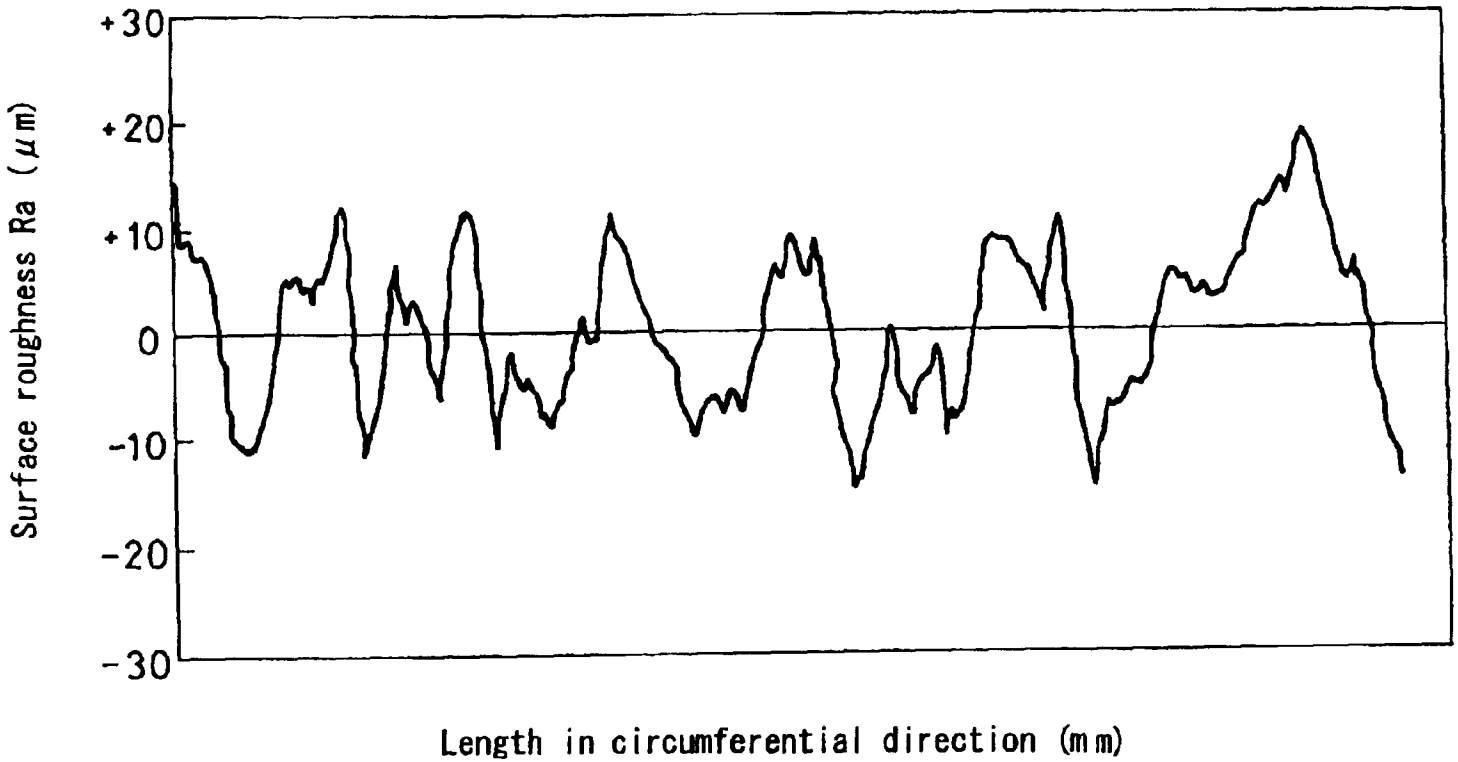
FIG. 7 is a graph showing the surface roughness profile of the satin-finished surface shown in FIG. 6A.

FIG. 7 is a profile of the satin-finished surface 23 formed by shot-peening, in which the vertical axis indicates the surface roughness while the horizontal axis indicates the length in a circumferential direction.

Figure 6B:
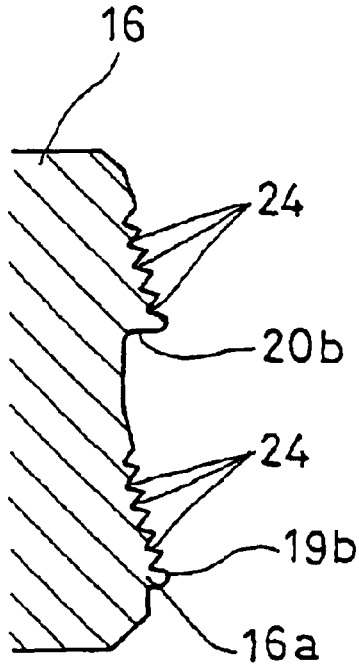

In FIG. 6B, a plurality of helical grooves 24 are formed in the pressure flanks 19*b* of the male threads 16*a* to roughen them. The helical grooves 24 may be formed by rolling or cutting. Like the helical grooves 22 of FIGS. 5B and 5C, the helical grooves 24 are preferably about 0.1–0.5 mm deep.

Figure 6C:
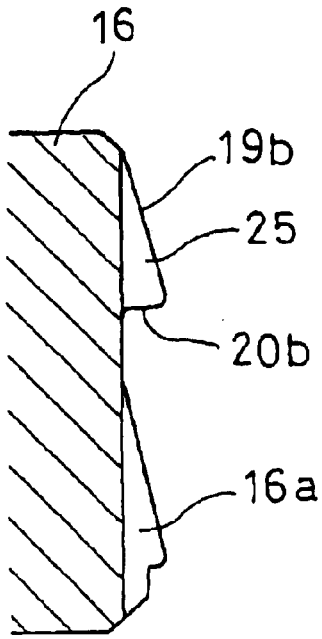

In FIG. 6C, a plurality of axial grooves 25 are formed to circumferentially divide the male threads 16*a* of the adjuster screw 16 into a plurality of separate portions.

Figure 6D:
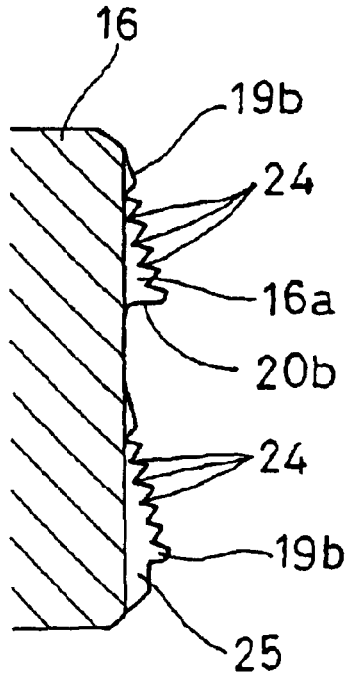

In FIG. 6D, both the axial grooves 25 shown in FIG. 6C and the helical grooves 24 shown in FIG. 6B are provided.

Table 1 shows possible combinations of threaded structures of the nut 14 shown in FIG. 5 with threaded structures of the adjuster screw 16 shown in FIG. 6.

TABLE 1

| Combination No. | 1 | 2 | 3 | 4 | 5 |
|---|---|---|---|---|---|
| Structure of inner surface of the nut | axial groove + helical groove | not treated | axial groove | axial groove | helical groove |
| Structure of outer surface of the adjuster screw | not treated | axial groove + helical groove | shot peening | helical groove | axial groove |

Figure 4:
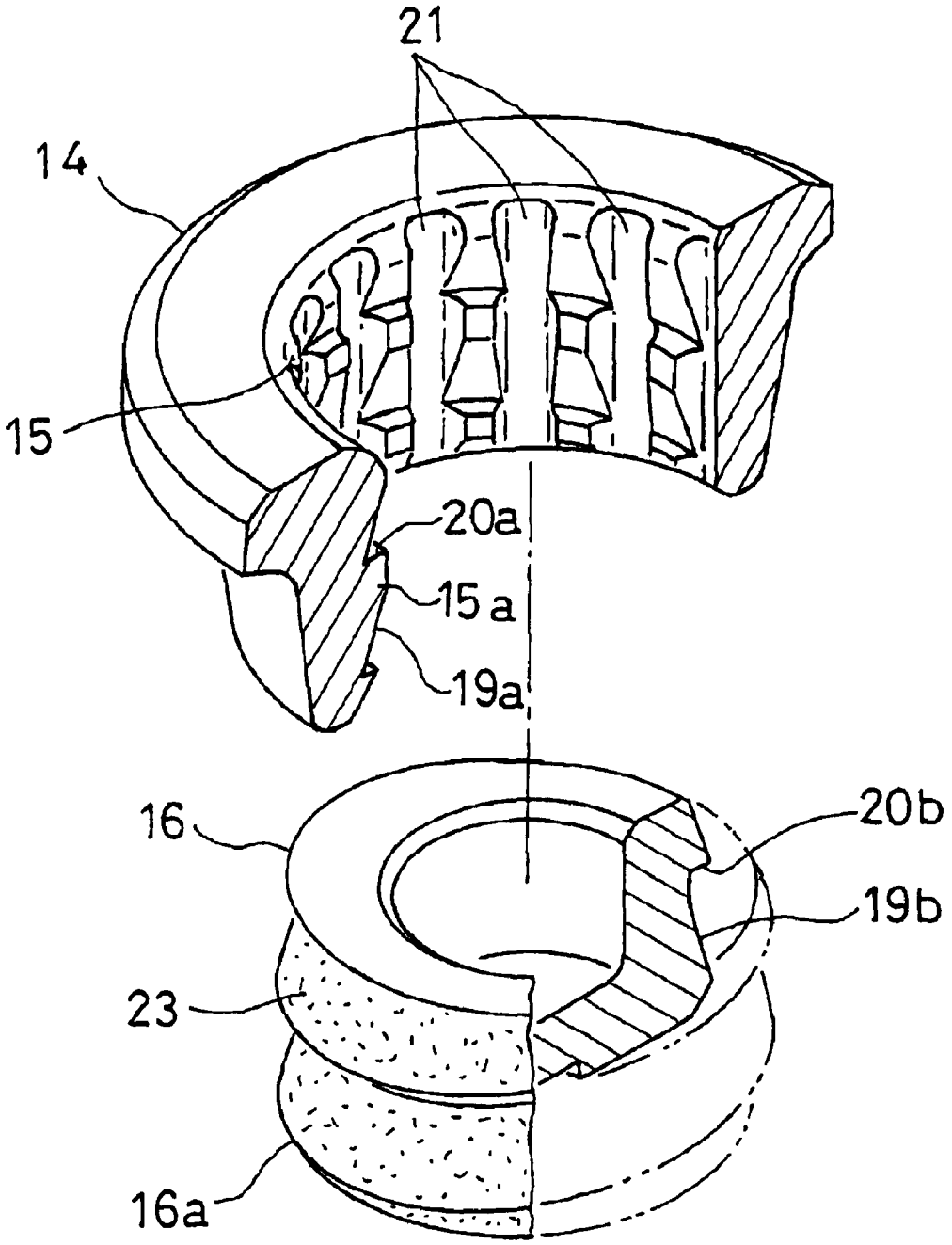
FIG. 4 is a partially cutaway exploded perspective view showing the nut and the adjuster screw.

FIG. 4 shows the combination No. 3 shown in Table 1.

In combinations No. 1 and No. 2, in one of the female threads 15*a* of the nut 14 and the male threads 16*a* of the adjuster screw 16, a plurality of axial grooves 21, 25 dividing the thread in a circumferential direction are formed and helical grooves 22, 24 are formed in the pressure flanks 19*a* or 19*b* of the thread divided by the axial grooves 21, 25. In combinations No. 3 to No. 5, in one of the female threads 15*a* and the male threads 16*a*, a plurality of axial grooves 21, 25 are formed whereas in the other of them, a satin-finished surface 23 or helical grooves 22, 24 are formed.

With any of these combinations, it is possible to smoothly and reliably expel lubricating oil present between the pressure flanks 19*a*, 19*b* when they move toward each other.

With these arrangements, in a situation where the adjuster screw 16 reciprocates relative to the nut 14 within the gaps between the female threads 15*a* and the male threads 16*a*, when the pressure flanks 19*b* of the male threads 16*a* and the pressure flanks 19*a* of the female threads 15*a* move toward each other, lubricating oil therebetween is smoothly discharged through the axial grooves 21 or 25 until the pressure flanks 19*a*, 19*b* come close to each other. When the pressure flanks 19*a*, 19*b* come into contact with each other, the lubricating oil still remaining therebetween will flow through the satin-finished surface 23 or the helical grooves 22 or 24 into the axial grooves 21 or 25 and then will be discharged therethrough.

Thus, lubricating oil between the pressure flanks 19*a*, 19*b* can be quickly and reliably expelled from space between the pressure flanks 19*a*, 19*b*. The pressure flanks 19*a*, 19*b* are thus pressed against each other with substantially no lubricating oil disposed therebetween, so that the friction therebetween is kept high when they are pressed against each other. The high frictional force therebetween prevents the adjuster screw 16 from turning and being pushed into the nut 14 due to the axial pressure transmitted through the pressure flanks 19*a*, 19*b*.

Another feature of these arrangements is that the helical grooves, axial grooves and/or satin-finished surface keep a sufficient roughness of the pressure flanks 19*a*, 19*b* even when the pressure flanks 19*a*, 19*b* have worn considerably, thereby keeping a sufficiently high frictional force therebetween. This also prevents the adjuster screw 16 from turning and being pushed into the nut 14. Thus, it is possible to provide a stable valve lift.

For a lash adjuster including the nut 14 shown in FIG. 5C, i.e. a nut having both the axial grooves 21 and the helical grooves 22, and a lash adjuster including the nut 14 shown in FIG. 5A, i.e. a nut having only the axial grooves 21, and the adjustor screw 16 shown in FIG. 6A, i.e. an adjuster screw having the satin-finished surface 23 formed by shot peening on the pressure flank 19*b* of the male thread 16*a*, a low-temperature characteristics test was conducted after using them in a harsh environment. The results of the test are shown in FIGS. 8A and 8B.

Figure 8B:
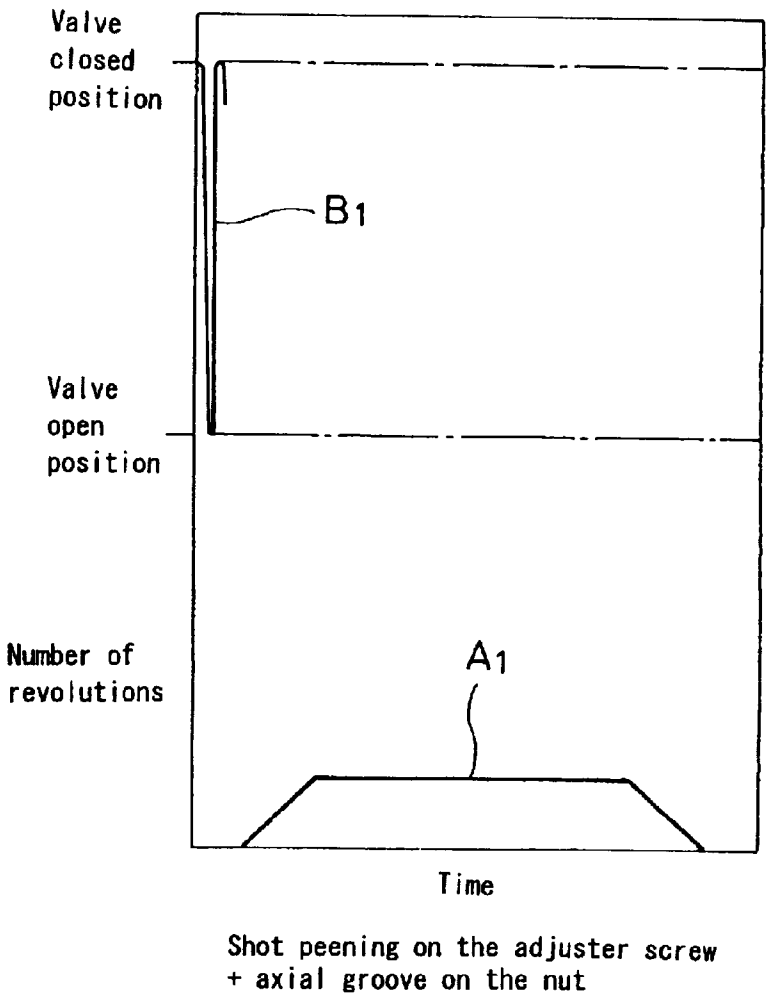
FIGS. 8A and 8B are graphs showing the results of a low-temperature characteristic test after long use.
Figure 8A:
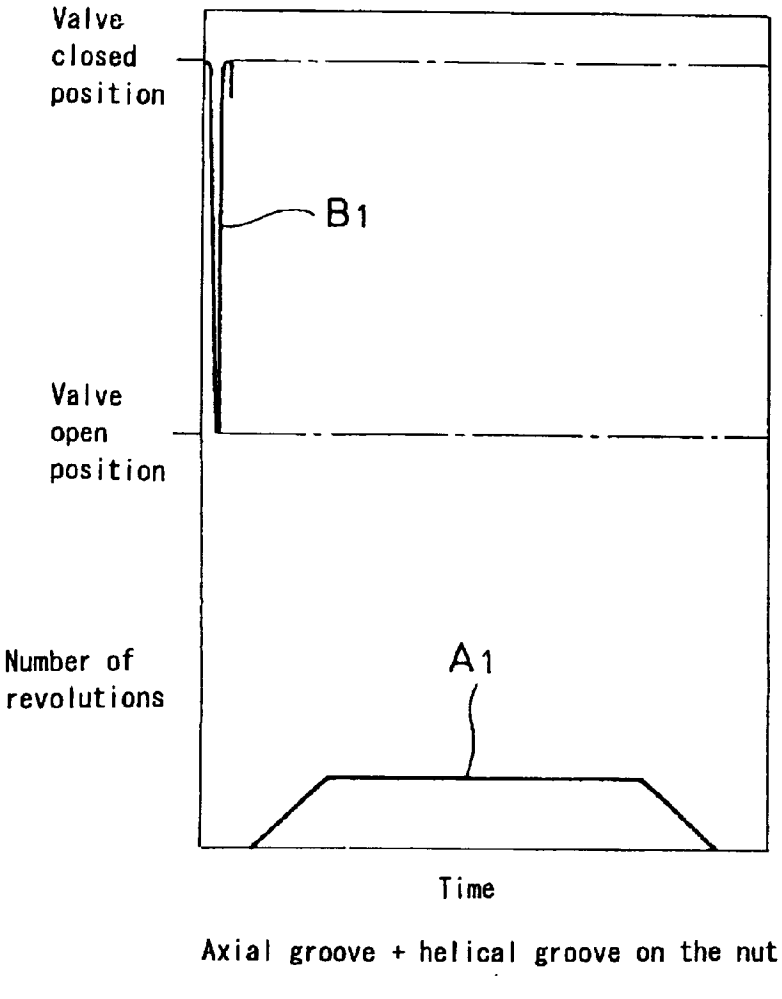

In the graphs of FIGS. 8A and 8B, the lower lines $A_1$ show the number of revolutions of the crankshaft. As shown, the crankshafts were rotated at a constant speed.

The upper curves B1 are lift curves for the valve 5 showing closed positions and fully open positions of the valve. While only part of each lift curve is shown, it is to be understood that closed positions and fully open positions of the valve alternate along the upper chain line and the lower chain line, respectively, in the time axis direction.

Figure 9A:
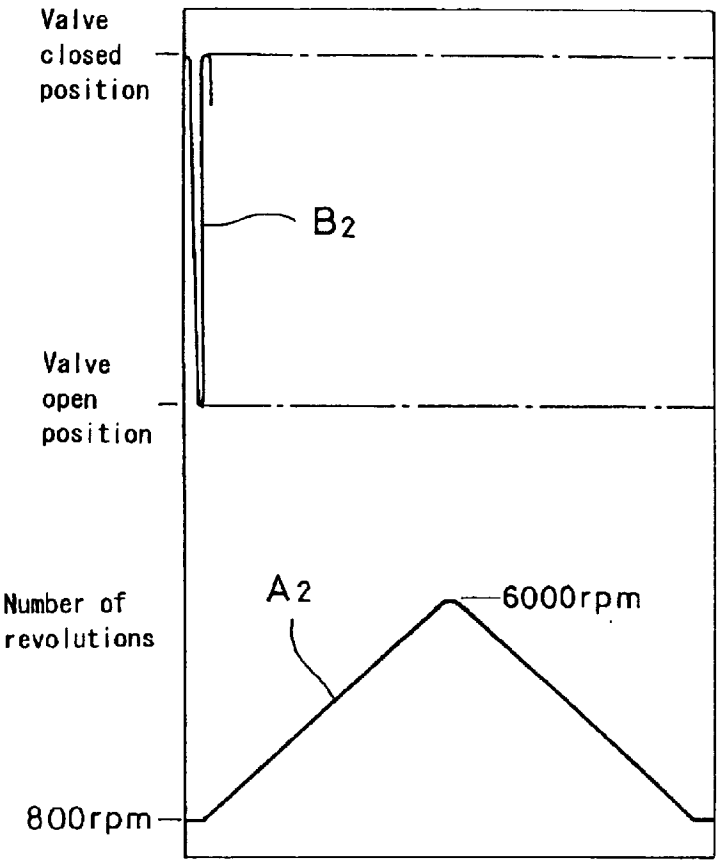
FIGS. 9A and 9B are graphs showing the results of revolving number sweep tests of lash adjusters having axial grooves formed in the threaded hole before and after endurance.
Figure 9B:
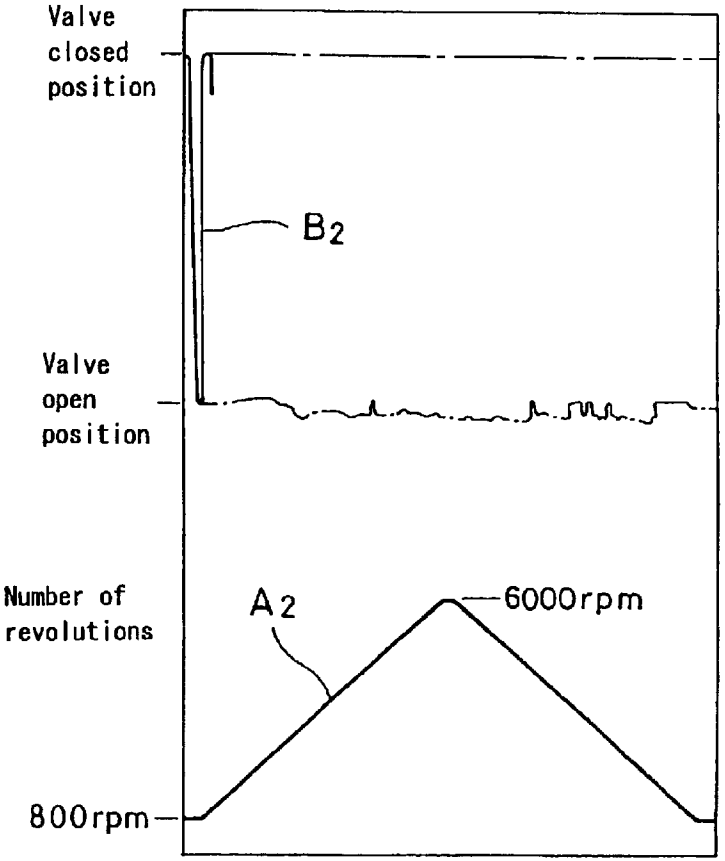

FIGS. 9A and 9B show the results of sweep tests for a lash adjuster including a nut 14 having only the axial grooves 21 formed in the inner periphery of the threaded hole 15 for the number of revolutions of the crankshaft. FIGS. 9A and 9B show the results before and after the endurance test.

Figure 10A:
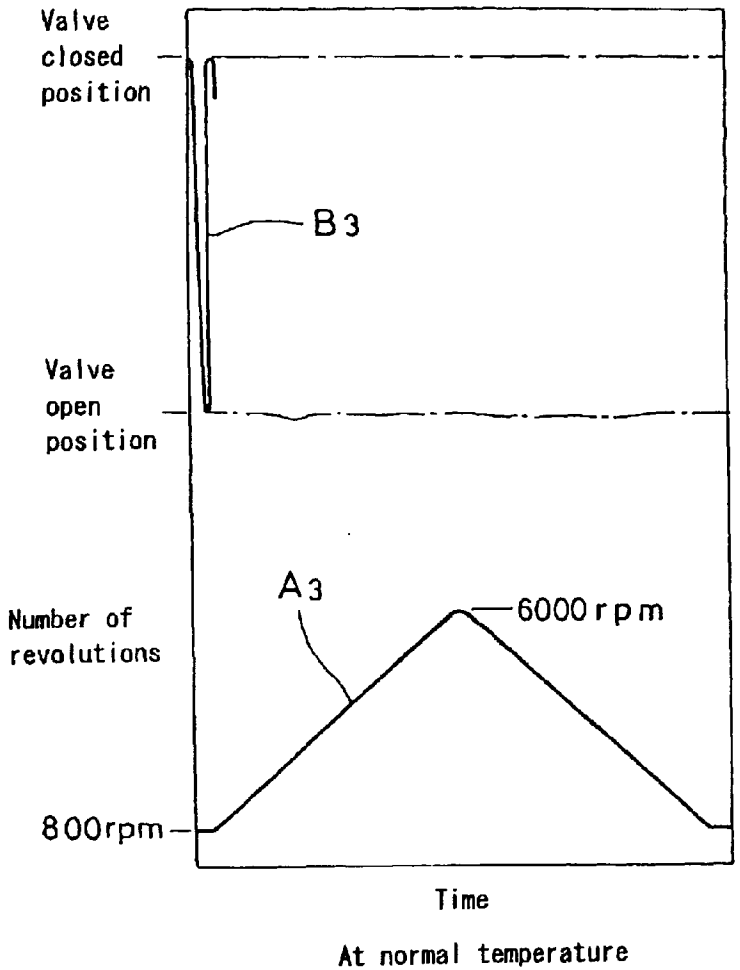
FIGS. 10A and 10B are graphs showing the results of a revolving number sweep test of a lash adjuster having female threads having pressure flanks formed with helical grooves.
Figure 10B:
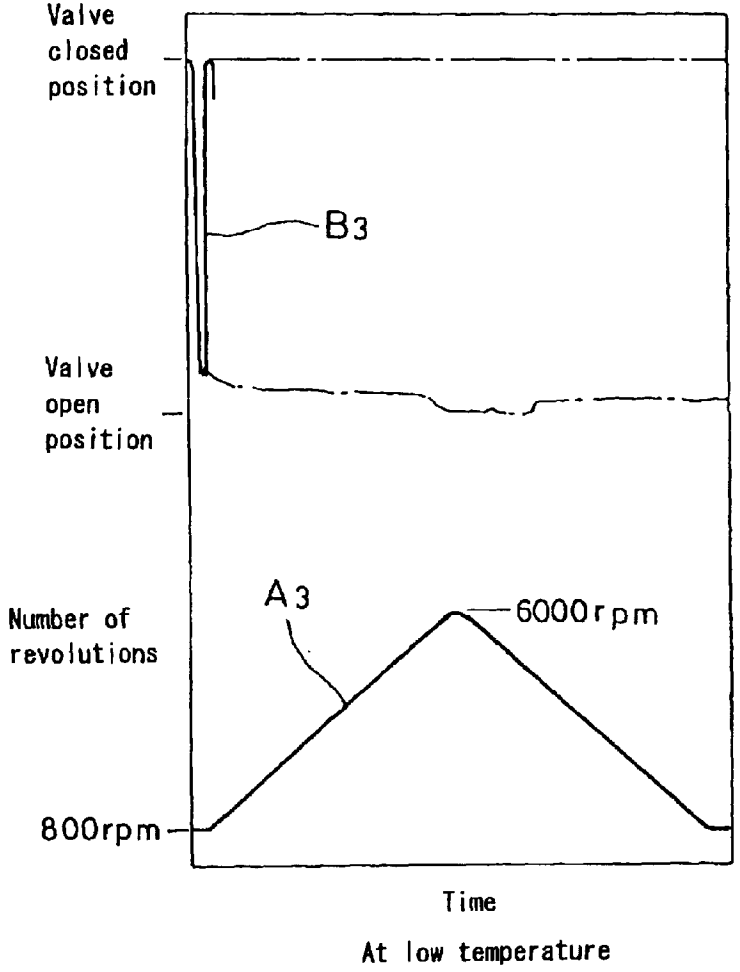
Figure 11A:
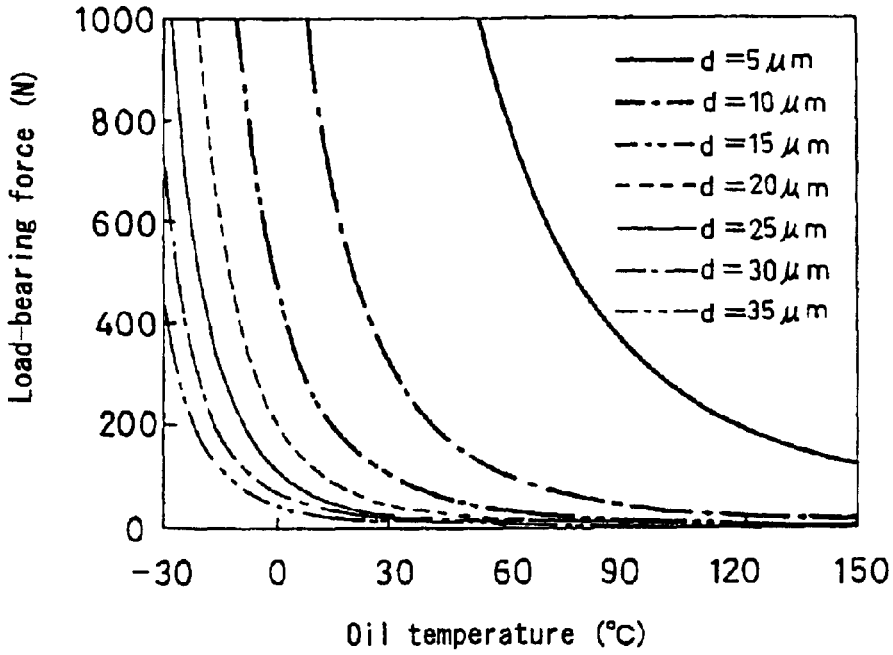
FIG. 11 is a graph showing the relationship between the temperature and the load-bearing force of the oil film.
Figure 11B:
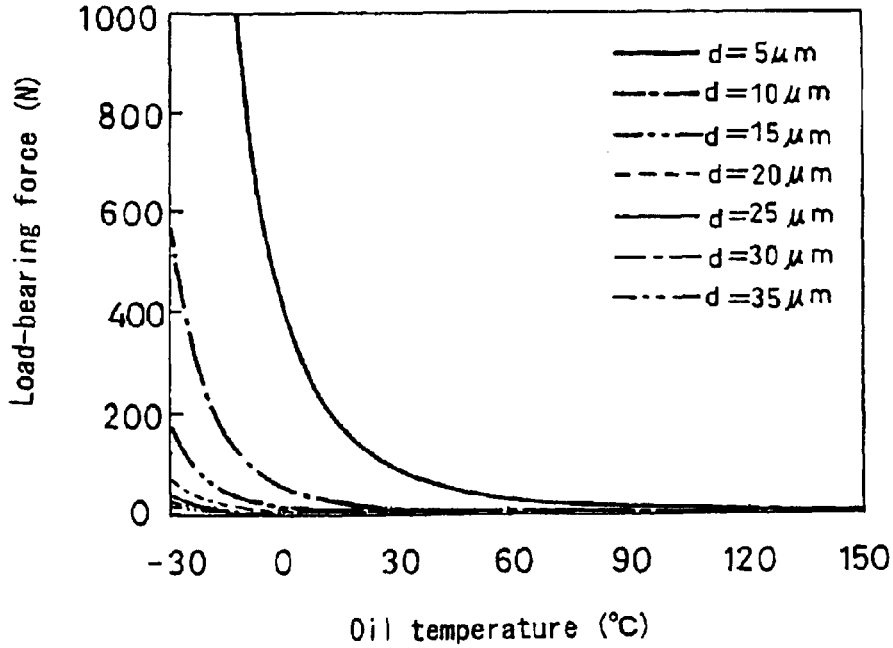

FIGS. 10A and 10B show the results of sweep tests for a lash adjuster including a nut 14 having only the helical grooves 22 formed in the pressure flank 19*a* of the female thread 15*a* for the number of revolutions of the crankshaft. FIG. 10A shows the test results at normal temperature while FIG. 10B shows the test results at a lower temperature.

In FIGS. 9A, 9B and 10A and 10B, lower curves $A_2$ and $A_3$ show the number of revolutions of the crankshaft which linearly increased from 800 rpm idling to a maximum of 6000 rpm and then linearly reduced to the 800 rpm idling speed.

Similar to the lift curves B1 of FIGS. 8A and 8B, the lift curves B2 and B3 show how the closed position and fully open position of the valve changed.

From these results, it will be apparent that with a lash adjuster including the nut 14 shown in FIG. 5C with the axial grooves 21 in the threaded hole 15 and the helical grooves 22 on the pressure flank 19*a* of the nut, or a lash adjuster including the nut 14 of FIG. 5A with the axial grooves 21 in the threaded hole 15 and the satin-finished surface 23 on the pressure flank 19*b* of the male threads 16*a*, it is possible to reliably expel oil film even at low temperatures, and also keep high friction coefficiency between the pressure flanks 19*a*, 19*b* even after long use. Thus, stable valve lift characteristics are maintained.

In the embodiment of FIG. 1, the lash adjuster according to this invention is mounted in a direct type valve actuator to automatically adjust the valve clearance. But it can also be used with an end pivot type valve actuator. Further it may be used in an auto-tensioner or chain tensioner.

With this arrangement, when the opposed pressure flanks on the threads repeatedly move toward and away from each other, it is possible to quickly and reliably expel oil film from between the pressure flanks.

Thus, the pressure flanks can be reliably brought into contact with each other without oil film disposed therebetween. The friction therebetween is thus kept high. This prevents the adjuster screw from being pushed into the nut while turning. Thus, a stable valve lift is maintained.

Even if the pressure flanks get worn, the rugged surface formed on one of the pressure flanks keeps sufficient roughness and thus frictional resistance to keep the adjuster screw from turning. Thus, a stable valve lift is maintained for a long period of time.

What is claimed is:

1. A lash adjuster comprising a lifter body including an end plate having a top surface and a bottom surface formed with an axial blind threaded hole having female threads, said lifter body axially slidably mounted between a cam and a stem of a valve with said top surface in contact with the cam, an adjuster screw having male threads on its outer periphery which are in threaded engagement with the female threads of said threaded hole, and an elastic member mounted in said threaded hole so as to bias said adjuster screw axially, said female threads of said threaded hole and said male threads of said adjuster screw being serration-shaped and having pressure flanks which receive pressure applied to said adjuster screw in such a direction as to push said adjuster screw into said threaded hole, and clearance flanks arranged between the adjacent pressure flanks, said pressure flanks having a greater flank angle than said clearance flanks, one of the inner periphery of said threaded hole and the outer periphery of said adjuster screw being formed with a plurality of axial grooves that divide said female threads or said male threads into a plurality of separate sections in a circumferential direction, and the pressure flanks of said female threads or said male threads that are not circumferentially divided by said axial grooves are formed with rugged surfaces, wherein said rugged surfaces are satin-finished surfaces formed by shot peening.

2. The lash adjuster claimed in claim 1 wherein said rugged surfaces are formed by helical grooves formed along the lead of said male or female threads.

* * * * *